United States Patent [19]

Buttner

[11] 4,428,522

[45] Jan. 31, 1984

[54] STEP DRIVER

[75] Inventor: Robert C. Buttner, Syracuse, N.Y.

[73] Assignee: Concrete Pipe & Products Corp., East Syracuse, N.Y.

[21] Appl. No.: 335,737

[22] Filed: Dec. 30, 1981

[51] Int. Cl.[3] ..... B27F 7/02

[52] U.S. Cl. ..... 227/8; 227/100; 227/103; 227/110; 254/29 R

[58] Field of Search ..... 29/432; 52/19, 20, 21; 166/50, 100; 254/29 R; 227/7, 8, 100, 102, 103, 110, 111, 156

[56] References Cited

U.S. PATENT DOCUMENTS

| | | | |
|---|---|---|---|
| 2,058,182 | 10/1936 | Schmidtke | 227/102 X |
| 3,114,331 | 12/1963 | Elliott | 227/111 X |
| 3,523,633 | 8/1970 | Wilson | 227/7 |
| 3,989,177 | 11/1976 | Washabaugh, Jr. | 227/156 X |

*Primary Examiner*—Paul A. Bell

*Attorney, Agent, or Firm*—Bruns & Jenney

[57] ABSTRACT

Apparatus for placing steps in a concrete pipe or riser immediately after the pipe has been cast but before it is cured. A movable carriage is mounted upon a support column that is arranged to move a step driving mechanism vertically along the inner wall of the riser before the riser is removed from the casting jacket. The position of the carriage is automatically indexed to sequentially place the driving mechanism at the desired vertically spaced step locations. The drive mechanism is actuated at each location to drive a bifurcated member horizontally into the wall of the riser. In one embodiment of the invention the bifurcated member is a step that is automatically gravity loaded into the mechanism from an overhead supply magazine. In this embodiment of the invention the step is embedded in the riser and is set in place during curing. In another embodiment of the invention, the bifurcated member is a hole forming tool for accurately placing a pair of step receiving holes in the riser wall into which the steps are subsequently locked in place.

12 Claims, 8 Drawing Figures

STEP DRIVER

BACKGROUND OF THE INVENTION

This invention relates to apparatus for setting steps into the wall of a precast concrete riser.

Many concrete pipe sections requiring steps are now being fabricated in packerhead machines wherein the section is cast in an upright position inside a removable sleeve or jacket. The jacket provides a contoured form against which the pipe is cast and a support for holding the green concrete section in place as it is drying.

Heretofore, when steps were required to be placed in a precast section, a worker generally had to climb down into the section and either stake steps into the inner wall of the section by hand or, alternatively, form step receiving holes in the green concrete before it dried. Hand setting of the steps or step receiving holes is oftentimes an unsatisfactory operation. The worker, as he enters and exits the section can physically displace concrete from the riser thus damaging the structure. By the same token, hand set steps can also be easily misaligned during assembly whereupon the steps may become loosened and/or create a latent safety problem.

SUMMARY OF THE INVENTION

It is therefore an object of the present invention to improve apparatus for setting steps in concrete pipe and riser sections.

A further object of the present invention is to provide an automatic device for setting steps into a precast manhole riser.

Another object of the present invention is to provide an automatic step driver than can be retrofitted to existing pipe forming machins.

Yet another object of the present invention is to reduce the scrap rate of concrete risers requiring steps.

A still further object of the present invention is to improve the safety of the steps that are set or driven into a concrete riser or pipe section.

These and other objects of the present invention are attained by means of a step driving device suitable for use in conjunction with a machine for casting manholes in an upright position within a jacket. A carriage is mounted for reciprocation upon a support column and is arranged to pass a dependent slide vertically along the inside wall of the concrete riser. In operation, the carriage is indexed to sequentially position the slide at the desired spaced apart step locations. The slide is actuated at each step location to pass a bifurcated member horizontally into the riser wall. In the main embodiment of the invention the slide is adapted to automatically drive steps into the concrete. In a second embodiment of the invention, the slide is adapted to pass a bifurcated tool into the concrete to form a pair of holes into which a step may be set.

BRIEF DESCRIPTION OF THE DRAWINGS

For a better understanding of these and other objects of the invention, reference is had to the following detailed description of the invention which is to be read in conjunction with the accompanying drawings wherein.

DESCRIPTION OF THE INVENTION

Figure 1:
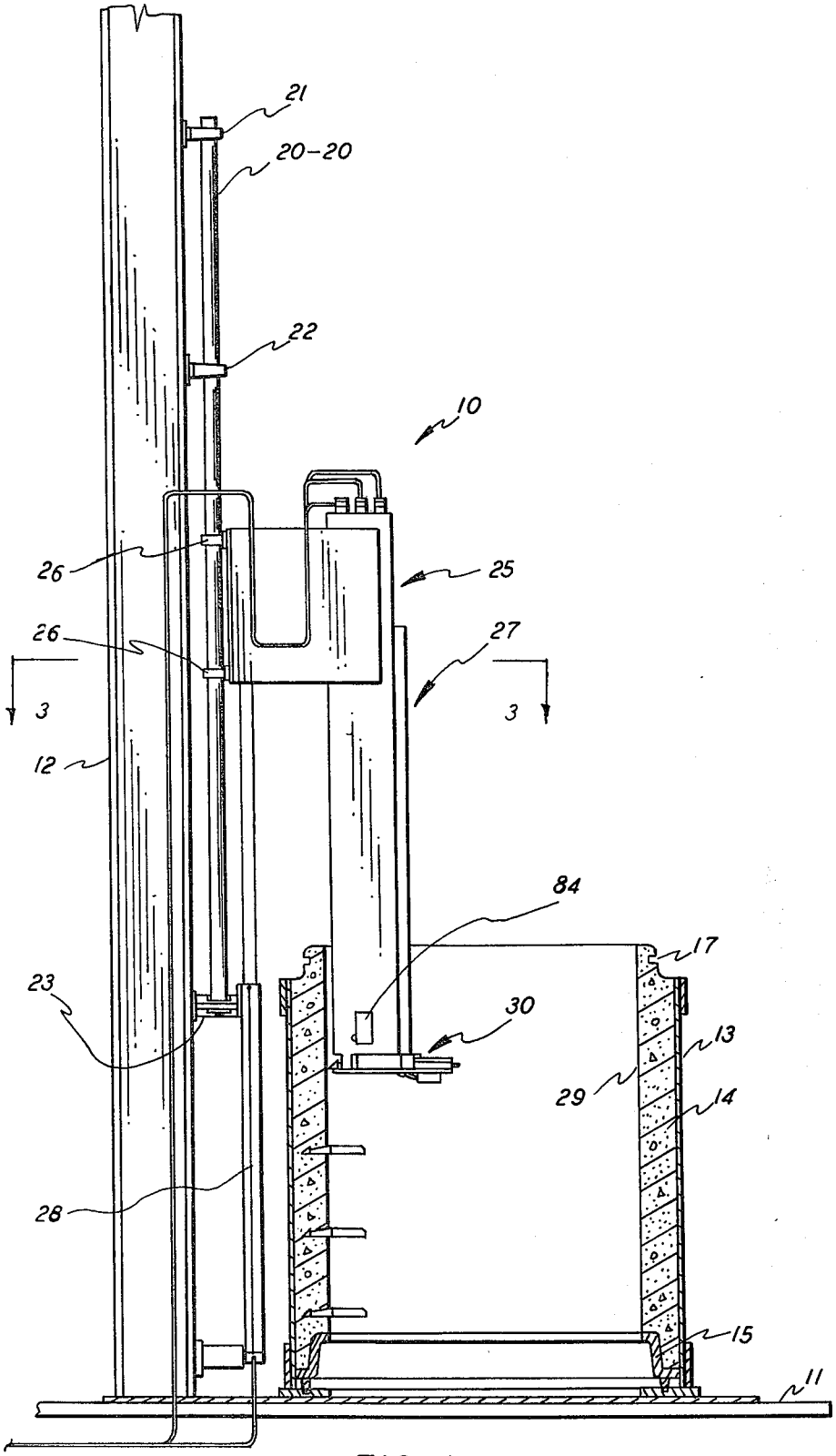
FIG. 1 is a partial side elevation showing the apparatus of the present invention employed in a packerhead machine for casting concrete riser or pipe sections.

With reference to FIGS. 1–7 wherein like numbers are used to identify like parts, there is illustrated a machine 10 for fabricating precast concrete pipe sections that are used as manhole risers in sewer systems and the like. The machine includes a movable turntable 11 that is adapted to rotate about a vertical support column 12 to transport one or more jackets 13 between a number of work stations. The jacket provides a form against which the pipe section is cast. In practice the jacket is set in an upright position upon a pallet 15 which serves to shape the bell end of the section.

Although not shown, a packerhead is situated at the first machine work station and is arranged to pass downwardly into the open end of the jacket and cast a concrete section 14 against the pallet and the jacket as shown in FIG. 1. The packerhead typically includes a header attachment that forms the tongue ring 17 in the male end of the riser section at the instant that the top table of the packerhead lifts away from the jacket.

After the casting operation has been completed, the jacket and the green concrete section are moved as a unit with the table into one or more subsequent work stations wherein further finishing operations are carried out. In the case of a manhole riser, it is found highly desirous to insert the the required number of steps into the riser sections before the precast concrete has a chance to set or be cured. As will be explained in greater detail below, the apparatus of the present invention is adapted to automatically drive steps into the riser at one of the subsequent work stations before the riser is offloaded. The automatic step driving operation eliminates the need for a workman to climb down into the riser section and thus considerably extends the productivity of the machine and reduces the scrap rate. Machines similar to that herein described capable of manufacturing up to 72 inch diameter pipe sections are available through Hydrolite Corporation of Nashua, Iowa.

As best seen in FIG. 1, the apparatus of the present invention can be conveniently mounted upon the support column 12 about which the turntable 11 rotates. The column is adapted to support a pair of parallel guide rails 20—20 that are generally cylindrical in form. The rails are affixed to the column in a vertical position by means of a pair of upper brackets 21 and 22 and a lower bracket 23. A carriage 25 is slidably supported between the rails upon ball bushings 26—26 so that it is able to be driven freely along a vertical path of travel between brackets 22 and 23.

Figure 2:
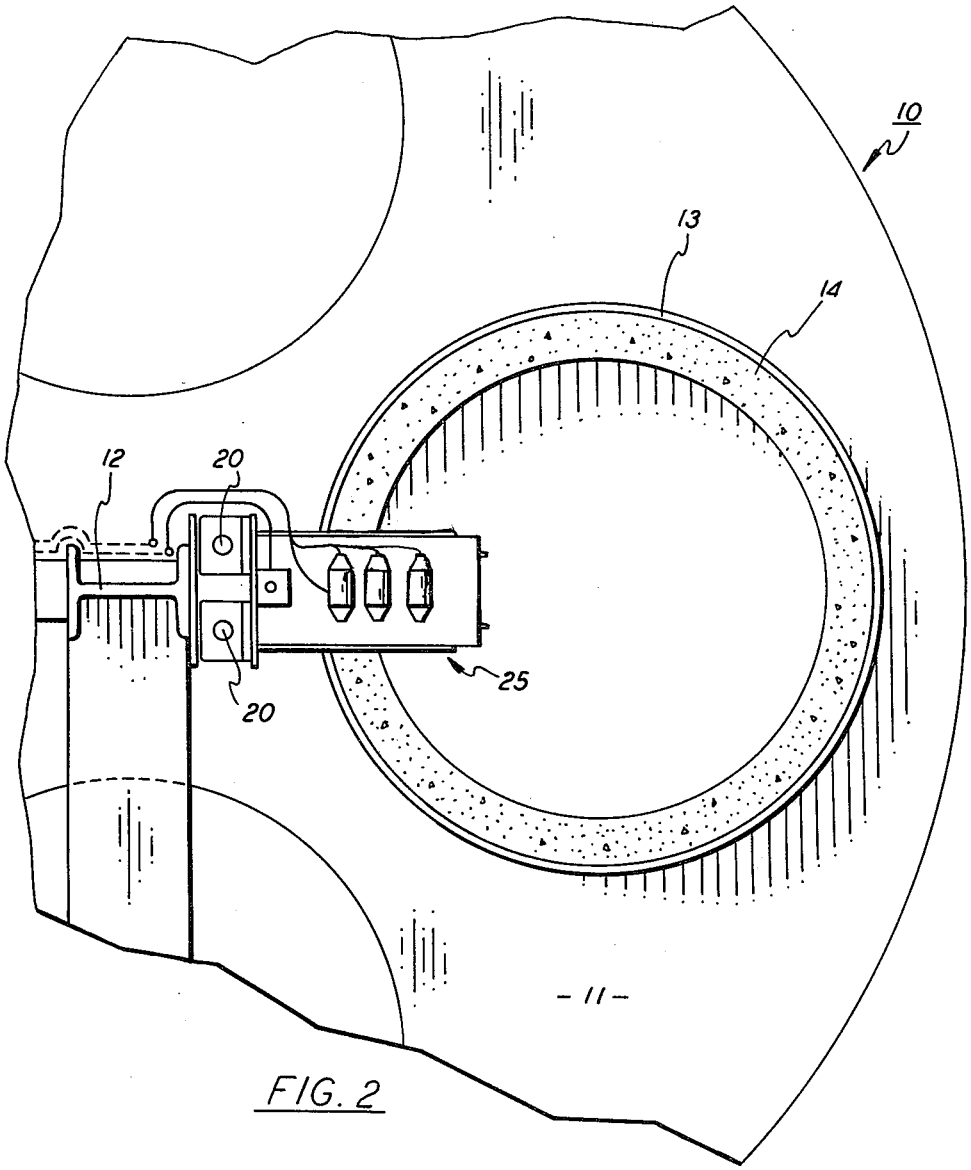
FIG. 2 is a plan view of the apparatus illustrated in FIG. 1 showing the carriage of the present invention situated over a precast concrete riser seated in an upright position upon the table of a packerhead machine.
Figure 3:
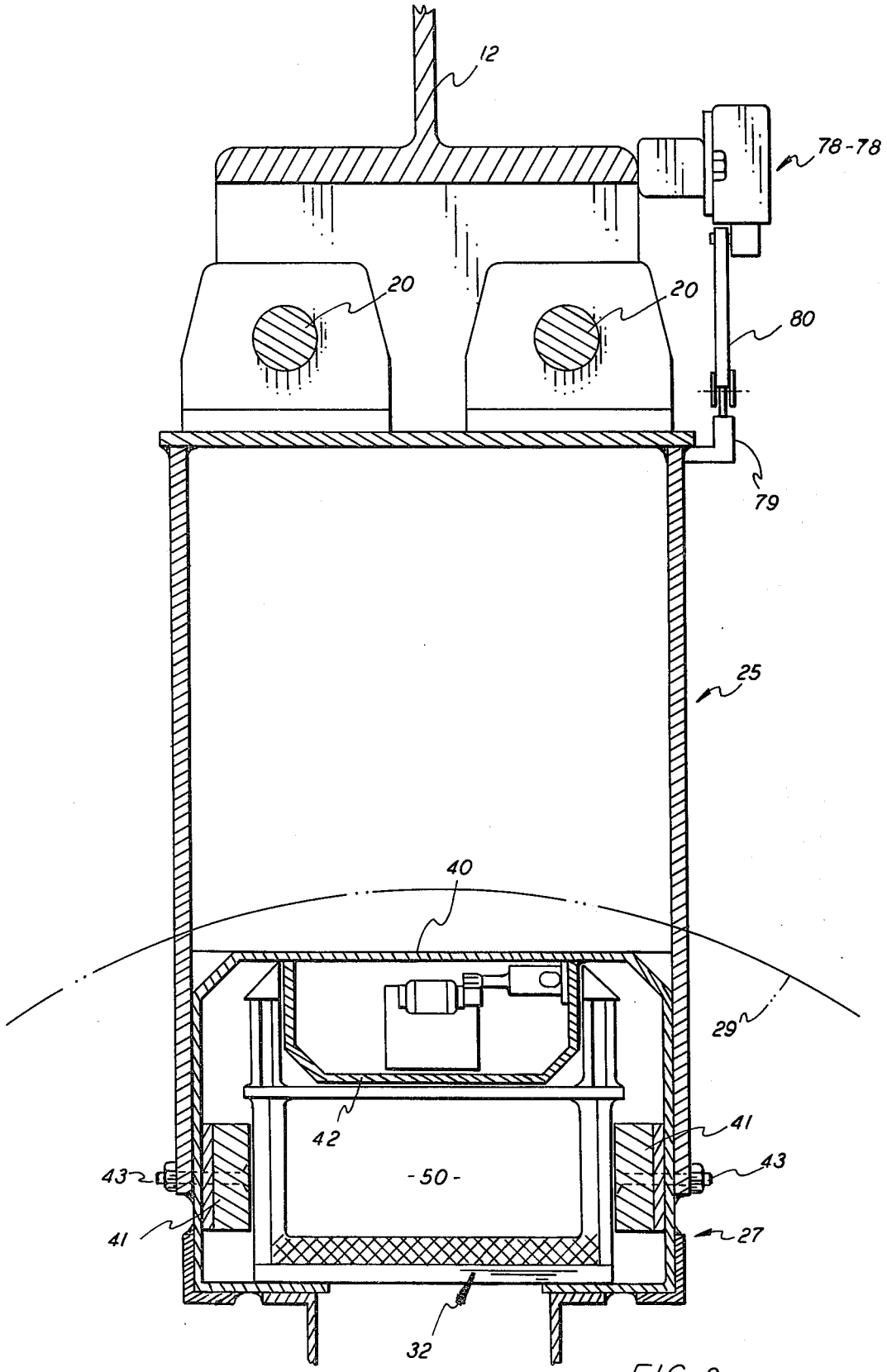
FIG. 3 is an enlarged section taken along lines 3—3 in FIG. 1.

With further reference to FIGS. 2 and 3, a step magazine, generally referenced 27, is secured to the carriage by any suitable means to suspend the magazine over a precast riser section that has been transported upon the table into a downstream work station. The magazine depends downwardly from the carriage and is of sufficient length to permit the distal end of the magazine to be lowered to the bottom of the riser section adjacent to the inside wall 29 thereof as the carriage moves along the guide rails. As will be explained in greater detail below, positioning of the carriage is controlled in order to index a step driving mechanism 30, which is located at the distal end of the magazine, into a desired number of vertically spaced step locations.

Figure 7:
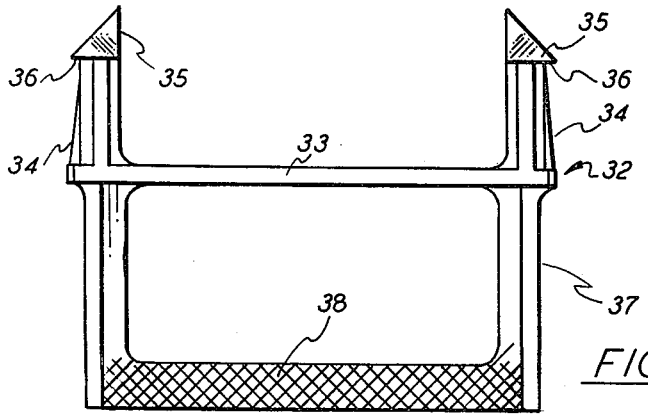
FIG. 7 is a top view of a step employed in the practice of the present invention.

With reference to FIG. 7, steps 32 that are loaded into the magazine generally include a centrally located main rib section 33 that supports a pair of outwardly protruding pointed stakes 34—34 to one side thereof. Each stake terminates with a chisel tip 35 that can be easily driven into the green concrete of the precast section. Each tip is also provided with a lateral flange 36 that prevents the step from pulling out once the concrete sets about the stake. A U-shaped footrest 37 extends outwardly from the other side of the main rib and furnishes a foothold or a hand hold to a person climbing in or out of the riser section. The top surface of the base leg 36 of each step is knurled or roughened to prevent slippage.

As illustrated in FIG. 3, the magazine 27 includes an enclosure 40 having a pair of replaceable elongated pads 41—41 secured via bolts 43—43 to the inside side walls thereof that extend vertically along the length of the housing. A front guide 42 is welded to the inside front wall of the enclosure which also extends vertically along the length of the enclosure. The side pads and the front guide cooperate to align the steps within the enclosure in a stack-like configuration so that the stakes of the step are directed at the inside wall 29 of the riser supported in the step driving work station. In practice, the steps are gravity fed one at a time into the step driving mechanism 30 and then passed horizontally by a slide into the riser wall.

Figure 4:
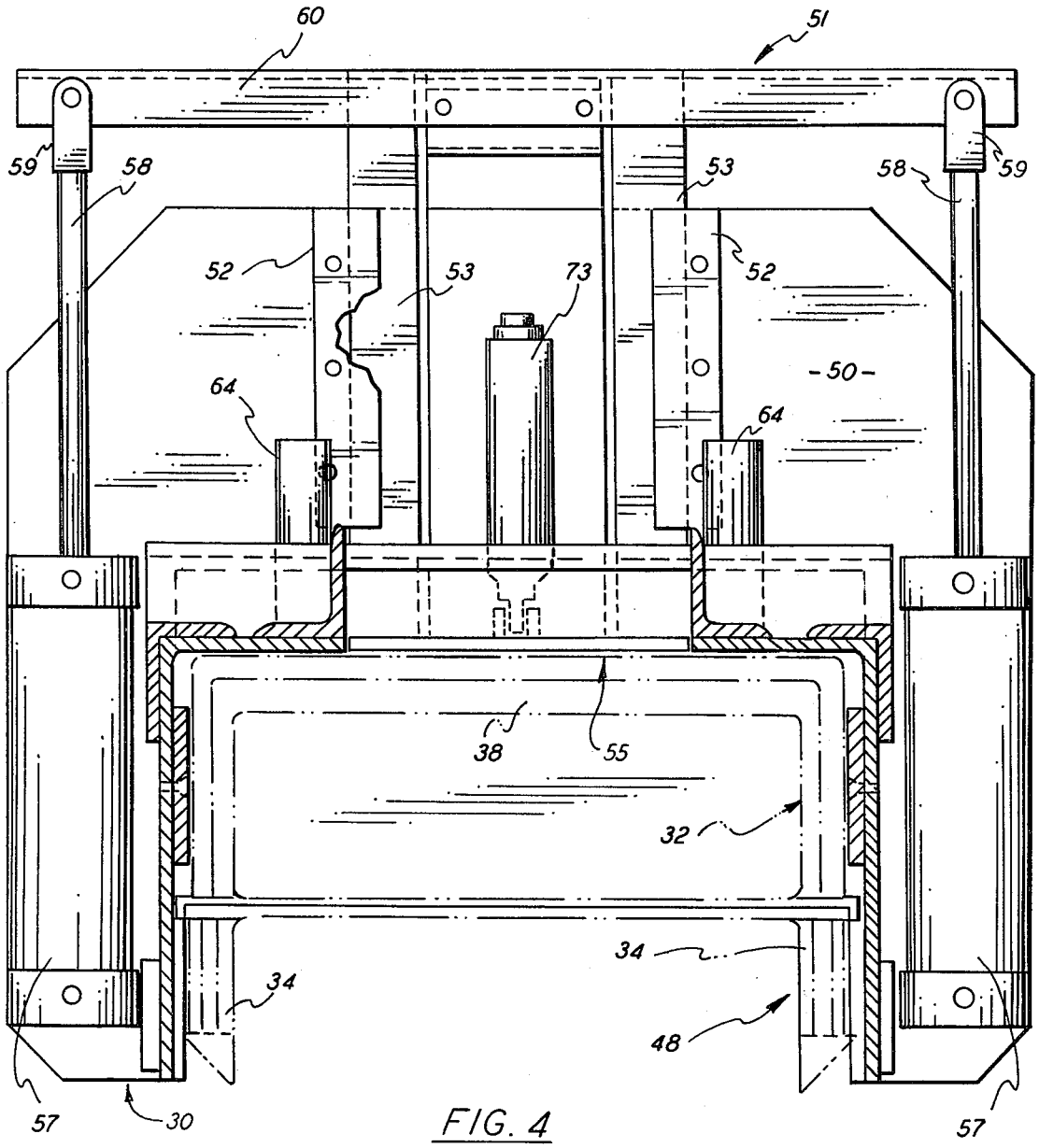
FIG. 4 is a further enlarged plan view showing a step driver mechanism used in the practice of the present invention for driving steps into the inner wall of a concrete riser.
Figure 5:
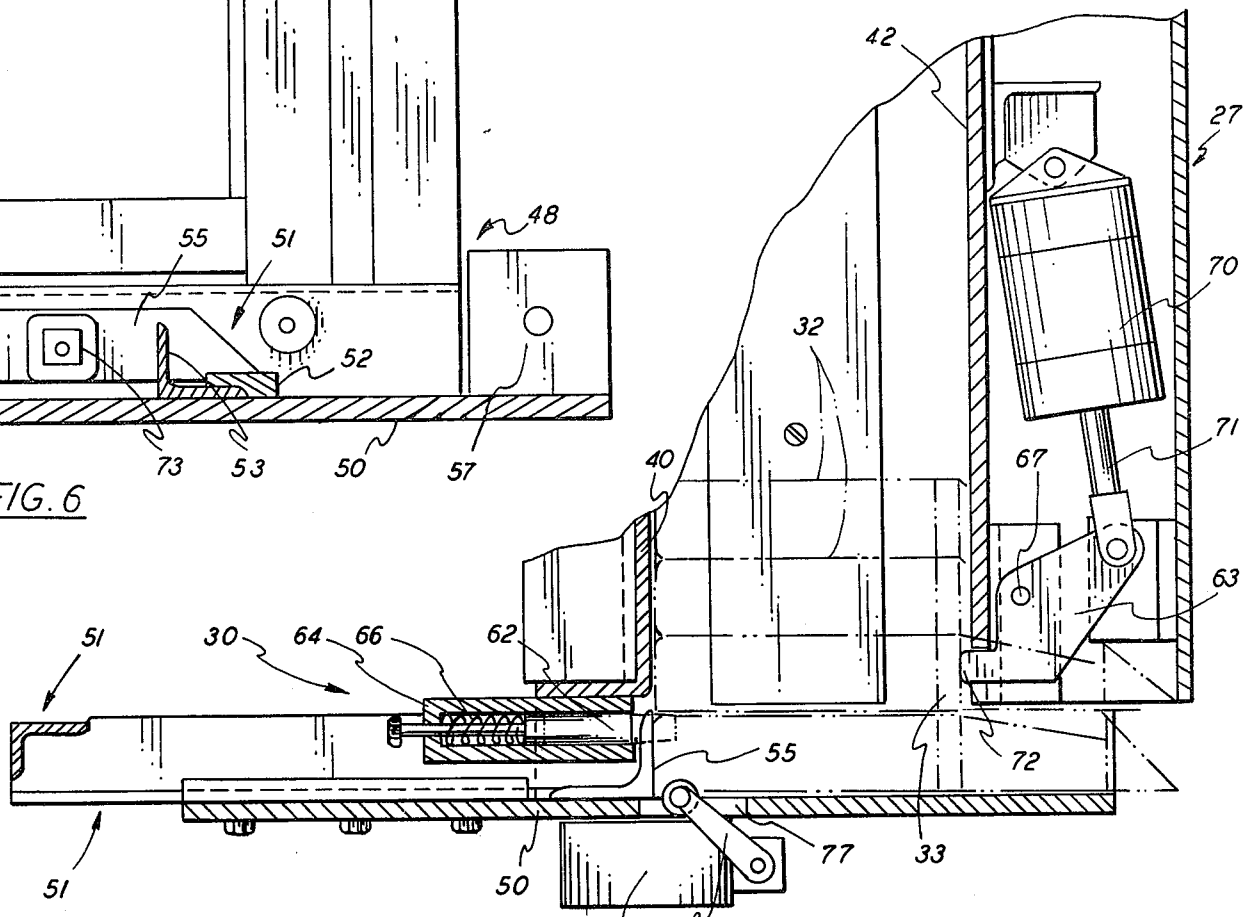
FIG. 5 is a partial side elevation in section showing the driver mechanism shown in FIG. 4.
Figure 6:
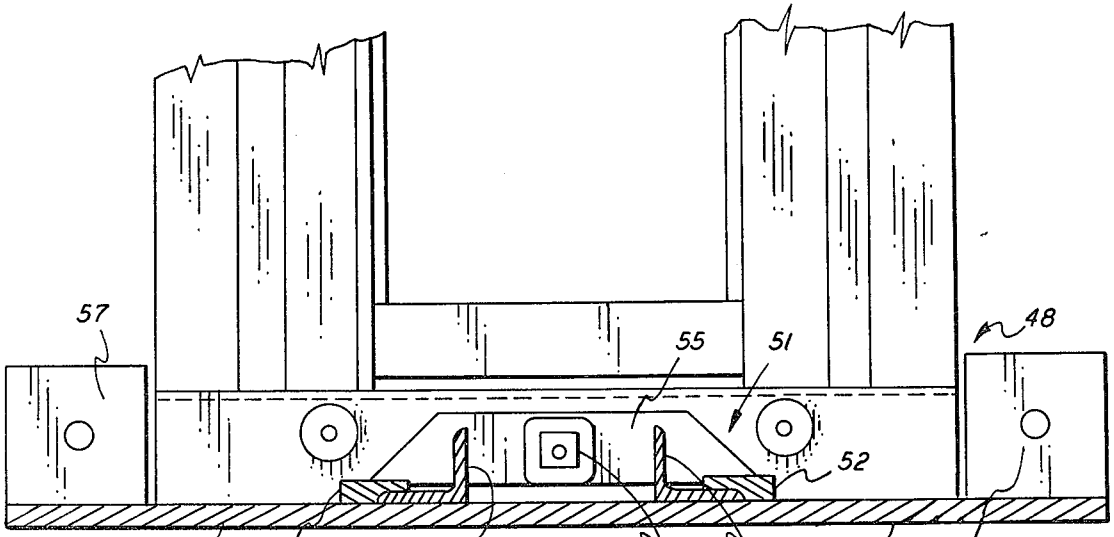
FIG. 6 is an end view of the driver mechanism showing the guides associated therewith.

As best illustrated in FIG. 4, the step driving mechanism 30 contains a pneumatically operated slide generally referenced 48, that is adapted to receive the lowermost step in the magazine stack and move it laterally a prescribed distance toward the riser wall to totally embed the entire length of the stake in the concrete. The slide is made up of a flat base plate 50 and a pusher assembly 51 that is movably supported on the plate by means of a pair of female guides 52—52. The guides 52—52 are adapted to slidably receive a pair of angle irons 53—53 therein which, in turn, are secured to the pusher assembly to direct the assembly along a horizontal path of travel. The pusher assembly further includes a driving bracket 55 that encompasses the back of the step. The back wall of the driving bracket engages the base leg 38 of the step and, in operation, drives the step forward.

As best seen in FIG. 4, the slide is driven by means of a pair of double acting pneumatic cylinders 57—57 that are secured to either side of the pusher bracket. The ram arm 58—58 of each cylinder is secured via a shackle 59—59 to an anchor plate 60 that is affixed to the magazine. Applying air to one side of the cylinder forces the bracket and the step loaded therein forward toward the riser wall. The bracket travel is controlled through the cylinder stroke so that the step is embedded in the wall a distance that is substantially equal to the length of the stakes 34—34. After the step has been driven, air is directed into the opposite side of each cylinder causing the pusher assembly to be retracted into the loading position.

The gravity loading of steps into the driving mechanism is controlled by means of a pair of spring loaded stop pins 62—62 (FIG. 5) that are arranged to act in concert with a camming plate 63. Each stop pin is contained within a cylindrical housing 64 that is secured by any suitable means to the back wall of the magazine enclosure. A biasing spring 66 is contained within each housing that urges the associated pin outwardly against the back wall of the step driving bracket 55. When the slide is retracted into a step loading position, the pins are forced back into the housings. Advancing the slide toward the riser wall, on the other hand, releases the pins and allows them to extend into the step loading region a sufficient distance to prevent the next step in the stack from moving downward onto the base plate.

The camming plate 63 is pivotably mounted in the front of the magazine enclosure upon a pivot pin 67. The activity of the plate is regulated by means of a solenoid actuated control cylinder 70 that is supported in the front guide over the camming plate. When a step is loaded into the slide the arm 71 of the cylinder is extended causing friction pad 72 on the plate to be rotated into holding contact against the main rib section 33 of the last step in the stack, that is, the next step to be loaded into the slide. Sufficient force is applied to the rib to hold the back of the step securely against the back wall of the magazine.

In operation, when a step that has been previously loaded in the slide is advanced, the stop pins 62—62 are extended to prevent the stack from moving down and thus fouling the slide mechanism. After the step has been driven, the slide is retracted to the loading position thereby pushing back the stop pins. The slide at this time is empty and the stack is now being supported by the friction pad 72 of the camming plate 63. The control cylinder 70, in response to a control signal, is deenergized pulling back the pad. The stack is now free to move down under the influence of gravity onto the base plate thus loading a new step into the slide. The control cylinder is energized to rotate the pad 72 into holding contact against the lowermost step in the magazine and the slide is now ready to be recycled through another step driving sequence.

A vibrator unit 73 is mounted upon the back wall of the driver bracket 55. The unit is actuated during each driving cycle and delivers sufficient oscillatory energy into the slide to help vibrate the step into the green concrete and to help prevent steps from hanging up in the slide as they are being loaded. Any step that tends to become canted or turned as it drops into the slide is quickly shaken loose and aligned in the desired horizontal driving position. A sensing switch 75 is positioned beneath the base plate that has an arm 76 which passes through an opening 77 provided in the base plate immediately below the step loading region. The normally opened contacts of the switch are closed only after a step has been loaded into the slide. Although not shown, the switch is wired in series into the slide control circuitry and must be closed before the driven cylinders can advance the slide.

A series of limit switches 78—78 (FIG. 3) are secured to the support column 12. The switches are mounted in vertical spaced alignment along the column and are arranged to intercept a lug 79 secured to the carriage by means of extended arms 80—80. The switches are also connected into the machine control circuit and provide information pertaining to the vertical location of the carriage and thus also the vertical location of the step driving mechanism. The carriage is preferably a hydraulically operated elevator that is driven and braked by means of a drive cylinder 28. At the start of a step driving operation, the control system is initially signalled when a green concrete riser has been rotated on the table into the step driving work station. The carriage then lowers the magazine and step driving mechanism into the riser until the last limit switch in the series is made. The downward movement of the carriage is terminated when the step driving mechanism is about opposite the position of the bottommost step. The carriage is halted and the presence of a step in the slide is sensed. If a step has been loaded into the slide, a step driving cycle is initiated whereupon the slide is driven forward to embed the bifurcated stakes into the riser wall. Because the concrete is green, and with the aid of the vibrator the concrete will tend to flow around the stakes and thus subsequently create a secure permanent bond after curing. The outer jacket against which the riser is cast, adds strength to the green casting so that the structure will not crumble under the driving force of the slide.

After the first step has been driven, the carriage is raised or indexed until the next limit switch in the series is made stopping the carriage whereupon another step is driven. Typically the vertical distance between steps will be somewhere between twelve and sixteen inches. The axial length of the riser sections, however, generally vary depending upon its intended use. Accordingly, the number of steps required will change in accordance with the height of the riser. A photocell 84 (FIG. 1) is mounted upon the side wall of the magazine that is capable of optically sensing the top rim of the riser and in response thereto, signals the control system that no further steps are required. The control system upon receipt of the signal, then automatically raises the carriage to a fully elevated or home position. The home position is sensed by the last or uppermost limit switch in the series. In the home position, the step driving mechanism is brought to an elevation that is clear of the jacketed precast risers so that the table can be rotated thereunder allowing the precast riser to be offloaded.

Figure 8:
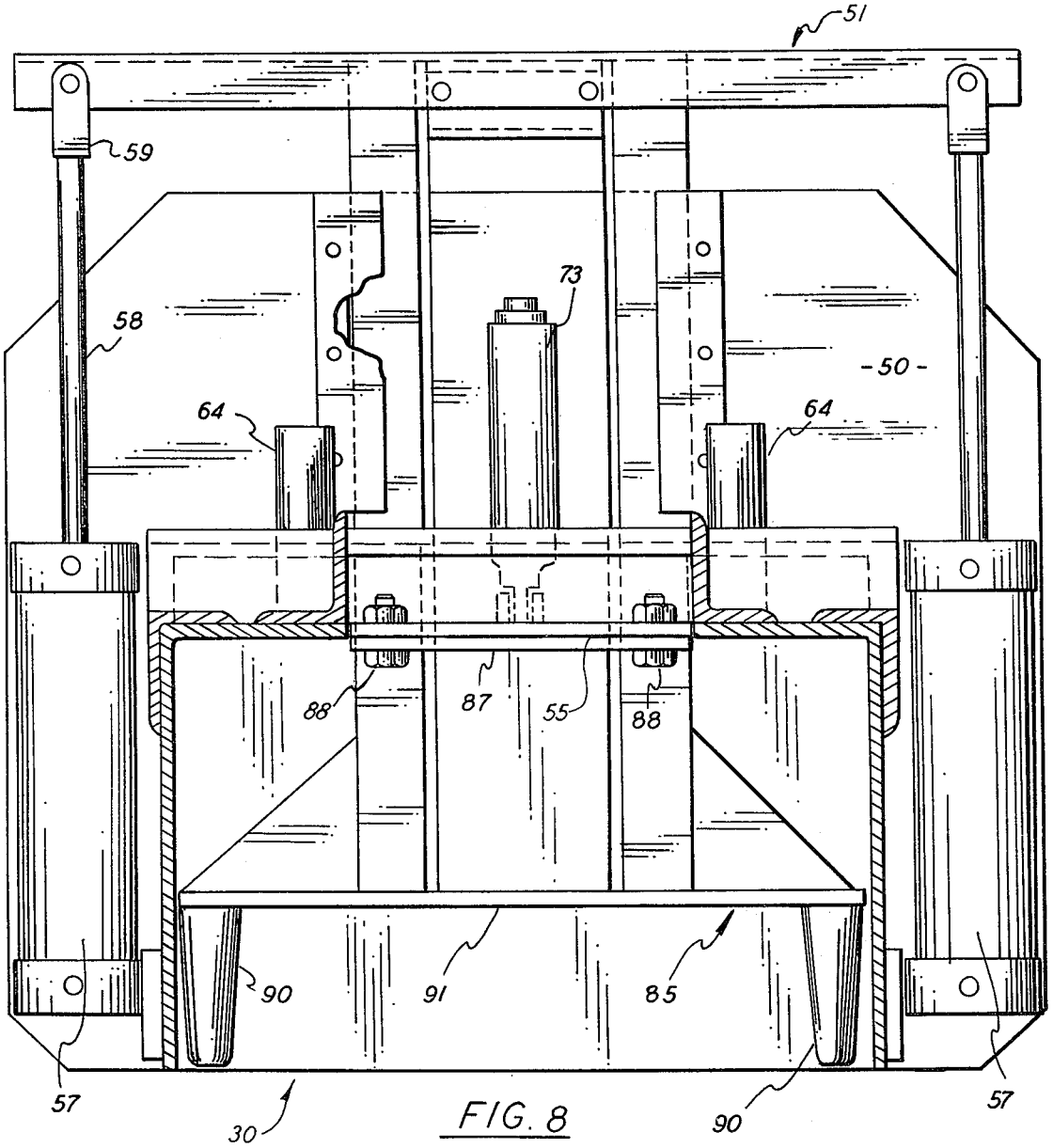
FIG. 8 is a plan view of the driver mechanism showing the slide adapted to pass a pair of hole drivers into the inner wall of a precast riser.

Although the apparatus of the present invention is ideally well suited for accurately and automatically driving steps into a precast riser section, there may be times when it is desirable to simply drive the step receiving holes accurately in the riser so that the steps can be accurately set into the concrete at some later time. FIG. 8 shows an embodiment of the invention wherein the slide is modified to reciprocally move a bifurcated hole forming tool 85 into and out of the riser wall. In this embodiment, the step supply magazine is emptied and the tool is placed in the slide as shown in the same position as that of a loaded step. The tool contains a back plate 87 that is secured to the back wall of driver bracket 55 by bolts 88—88. A pair of hardened tapered pins 90—90 are secured in the front wall 91 of the tool and protrude outwardly therefrom in a horizontal direction. The tapered pins are about the same length as that of the step stakes that are to be received therein.

In operation, the carriage is indexed as described above to sequentially position the driving mechanism at the desired step location. The slide is cycled as noted to drive the pins into the riser wall thus forming accurately located step receiving holes. When the procedure has been completed, the carriage is raised to the home position and the table sequenced.

While this invention has been described with reference to the details as set forth above, it is not limited to the specific structure as disclosed and the invention is intended to cover any modifications or changes as may come within the scope of the following claims.

I claim:

1. Apparatus for driving steps into a precast riser section that is supported in an upright position within a jacket that includes a stationary support column for movably supporting a carriage for movement back and forth over a vertical path of travel between a raised home position and a fully extended lowermost position, means for positioning a precast riser in an upright position adjacent to the stationary column whereby the column is located on the outside of the riser, an elongated bracket suspended from the carriage that is arranged to pass downwardly into the riser as the carriage is lowered from the home position toward the lowermost position, a slide means mounted in the distal end of the bracket for moving a bifurcated member into the riser wall, and control means for sequentially indexing the carriage to position the slide means at predetermined step locations and reciprocating the slide means to drive the bifurcated member into the wall at each step location.

2. The apparatus of claim 1 wherein the bifurcated member is secured to slide means for reciprocal movement therewith.

3. The apparatus of claim 1 wherein the bifurcated member is a step that is embedded in the concrete wall of the riser on the forward stroke of the slide means.

4. The apparatus of claim 3 that further includes a step magazine mounted over the slide means for automatically loading steps into the slide means upon completion of the return stroke.

5. The apparatus of claim 4 that further includes at least one spring loaded retaining pin that acts against a wall of the slide means so that it is urged beneath the steps stored in the magazine as the slide means moves forward to retain the step in said magazine and which is retracted by the slide means on the return stroke to permit the lowermost step in the stack to be loaded therein.

6. The apparatus of claim 5 that further includes a sensing means for sensing the presence of a step in the slide means and, in response thereto, enabling the forward stroke of said slide means.

7. The apparatus of claim 1 that further includes a movable table for supporting the riser in an upright position and a drive means for moving the table to a work station adjacent the stationary column.

8. The apparatus of claim 1 that further includes a vibrator means that is operatively connected to the slide means.

9. In a machine for fabricating concrete pipe wherein the pipe is cast in an upright position within a jacket seated upon a worktable at a first station and the work table is moved to bring the pipe into a second station, the improvement comprising, a support column mounted adjacent the table, a carriage movably supported upon the column so as to move vertically along a path of travel towards and away from the table, a magazine depending from the carriage for movement therewith, said magazine being positioned on the carriage to pass downwardly into a pipe seated on the table in the second station adjacent to the inside wall thereof, said magazine having a chamber for storing a plurality of steps in a stack-like configuration over a slide means operatively mounted in the distal end of the magazine whereby steps stored therein are gravity loaded into said slide means, indexing means for sequentially positioning the carriage to locate the slide means at spaced apart step locations, and drive means for moving the slide mechanism toward the riser wall at each step location to embed a step seated therein into said wall and then return the slide means to a step loading position.

10. The improvement of claim 9 that further includes a pair of spring loaded pins arranged to act against a rear wall of the slide means to automatically extend beneath the stack of steps stored in the magazine as the slide means moves forward and thus retain the steps in the magazine and to automatically retract as the slide means is returned to permit the bottommost step in the stack to be loaded into the slide.

11. The improvement of claim 10 that further includes a pivot arm rotatably supported in the front of the magazine that acts upon the lowermost step in the stack to bias the step against the back of the magazine and a release means for momentarily rotating the arm out of biasing contact with said step when the empty slide mechanism is returned to the loading position.

12. The improvement of claim 9 that further includes a vibrator means for oscillating the slide means.

* * * * *